United States Patent [19]

Morrison et al.

[11] Patent Number: 4,572,655

[45] Date of Patent: Feb. 25, 1986

[54] ELECTROPHOTOGRAPHIC COPYING APPARATUS AND METHOD OF USE INCLUDING ELECTROSTATIC TONER RECYCLING PROCEDURE

[75] Inventors: Elden R. Morrison, Palo Alto; Edward F. Mayer, San Jose; Donald F. Pfeuffer, San Jose; Victor B. van Blerk, San Jose, all of Calif.

[73] Assignee: Ricoh Systems, Inc., Tokyo, Japan

[21] Appl. No.: 516,954

[22] Filed: Jul. 25, 1983

[51] Int. Cl.[4] ..... G03G 21/00

[52] U.S. Cl. ..... 355/15; 118/652

[58] Field of Search ..... 355/15, 3 R; 118/652; 15/256.5, 256.51, 256.52

[56] References Cited

U.S. PATENT DOCUMENTS

| | | | |
|---|---|---|---|
| 3,637,306 | 1/1972 | Cooper | 355/15 |
| 3,700,328 | 10/1972 | Davidge et al. | 355/15 |
| 3,728,016 | 4/1973 | Harbour, Jr. et al. | 355/15 |
| 3,848,994 | 11/1974 | Fraser | 355/15 |
| 4,154,522 | 5/1979 | Ikesue | 355/15 |

*Primary Examiner*—R. L. Moses

*Attorney, Agent, or Firm*—Flehr, Hohbach, Test, Albritton & Herbert

[57] ABSTRACT

An electrophotographic copying apparatus utilizing a rotatable drum having a photosensitive outer circumferential surface is disclosed herein along with its method of operation. In making copies of a given sheet of information, an electrostatic latent image corresponding to the information to be copied is formed on a circumferential segment of the drum surface and the image is developed by applying toner onto the image bearing segment of the drum surface. Thereafter, the applied toner is transferred to a blank sheet thereby forming the copy. Once one or more copies are made from a given electrostatic image, any applied but untransferred toner on the drum surface is moved onto a second circumferential segment, preferably by means of a pliant roller segment and preferably with the aid of electrostatic attraction. The toner accumulated on the second segment of the drum surface is then moved by the latter to a specific point and removed from the second surface segment. During this latter movement, the toner is electrostatically held in place on the second drum surface segment.

16 Claims, 15 Drawing Figures

ELECTROPHOTOGRAPHIC COPYING APPARATUS AND METHOD OF USE INCLUDING ELECTROSTATIC TONER RECYCLING PROCEDURE

The present invention relates generally to electrophotographic copying apparatus and more particularly to a specific means for and method of recycling toner without using complicated recycling equipment.

The present invention is especially suitable for use in an electrophotographic apparatus of the general type disclosed in U.S. patent application Ser. No. 199,096 filed Oct. 20, 1980. The apparatus described there includes a rotatable drum having a photosensitive outer circumferential surface and means for rotating the drum in a controlled fashion so that its outer circumferential surface defines a fixed annular path of movement. This apparatus produces copies from a given master by first forming a given electrostatic latent image corresponding to the particular information to be copied on the photosensitive outer circumferential surface of the drum. Thereafter, the latent image formed is developed by means of toner which is applied to the image bearing surface in a particular way. Finally, the applied toner is transferred from the drum to a blank sheet for transforming the latter to the desired copy. The means necessary to carry out these various steps are specifically set forth in the pending application recited above and reference is made thereto. In the apparatus just described, a cleaning blade is utilized to wipe away residual development powder from the drum's outer circumferential surface, that is, any toner used to develop the latent image, but remaining on the drum after formation of the copy or copies therefrom. In most cases, this residual developing powder (hereinafter merely referred to as toner), is not again used, although in some cases it has been recycled using separate, relatively expensive recycling equipment requiring extra space for conveying the toner to its original storage area for further use. However, in U.S. patent application Ser. No. 434,720 filed Oct. 15, 1982, a less costly approach which requires no extra space is disclosed, as will be briefly discussed below.

The electrophotographic copying apparatus disclosed in the patent application just recited is similar to the one described above to the extent it utilizes the same rotatable drum to first form an electrostatic latent image on one circumferential segment thereof, which image is subsequently developed and transferred to a copy sheet. However, in accordance with the invention described in this latter application, after the transfer step, or steps, depending on how many copies are made from a given latent image, any applied but untransferred toner on the drum surface is moved into a smaller area thereon. Thereafter, this toner is moved along with the drum about an annular path of movement to a particular location where means are provided for removing the accumulated toner, preferably for re-use in the developing process.

The procedure just described in general provides an uncomplicated and relatively inexpensive way of reusing residual toner without the need for separate recycling equipment which can be relatively expensive and which requires extra space for conveying the toner to its original storage area for further use. However, it is a primary object of the present invention to provide an uncomplicated and reliable means for and method of improving the way in which residual toner is moved from the image bearing segment of the drum surface to an adjacent non-image bearing segment and an uncomplicated and reliable technique for holding the residual toner on this latter surface as the drum rotates the toner from its pickup point to its point of removal.

As will be described in more detail hereinafter, the electrophotographic copying apparatus disclosed herein utilizes a rotatable drum having a photosensitive outer circumferential surface and means for rotating the drum in the manner discussed above. The apparatus operates to form copies from the given master by first forming on the photosensitive drum surface an electrostatic latent image corresponding to information from the master. Thereafter, the latent image is developed by means of toner which is applied to the image bearing surface. This applied toner is ultimately transferred to a cooperating support surface, specifically a blank sheet which then becomes the copy. After this latter transfer step or steps, depending on how many copies are made from a given latent image, any applied but untransferred toner on the image bearing segment of the drum surface is moved onto a second, non-image bearing segment of the surface and then moved along with the drum about its annular path of movement to a particular location where means are provided for removing the accumulated toner.

In accordance with one aspect of the present invention, means are provided for electrostatically aiding in moving the residual toner (e.g., the applied but untransferred toner) from the image bearing segment of the drum surface to its non-image bearing segment and, once the residual toner is moved onto this latter segment of the drum surface, means for holding the toner thereon electrostatically while the drum moves it from its pickup point to its removal point. In accordance with another aspect of the present invention, the residual toner is physically moved from the image bearing segment of the drum surface to its non-image bearing segment by means of a compliant roller member manipulated in a controlled fashion relative to the movement of the drum. Much of the residual toner which accumulates on the compliant member during this latter procedure is moved therefrom to the non-image bearing segment of the drum by means of electrostatic attraction.

The various aspects of the present invention will be described in more detail hereinafter in conjunction with the drawings wherein.

Figure 1:
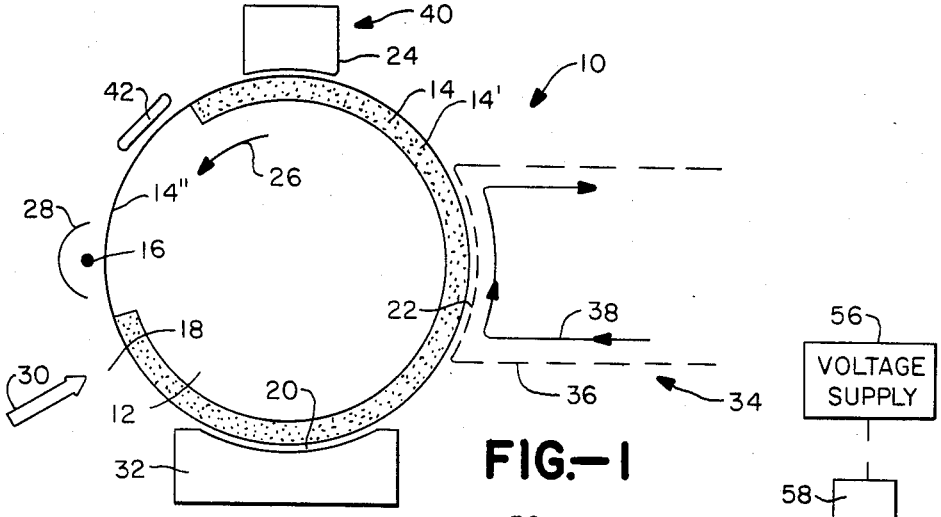
FIG. 1 is a diagrammatic illustration in plan view of an electrophotographic copying apparatus designed in accordance with the present invention, and specifically showing among other components its photoconductive drum which is used to develop an electrostatic latent image using toner.
Figure 3:
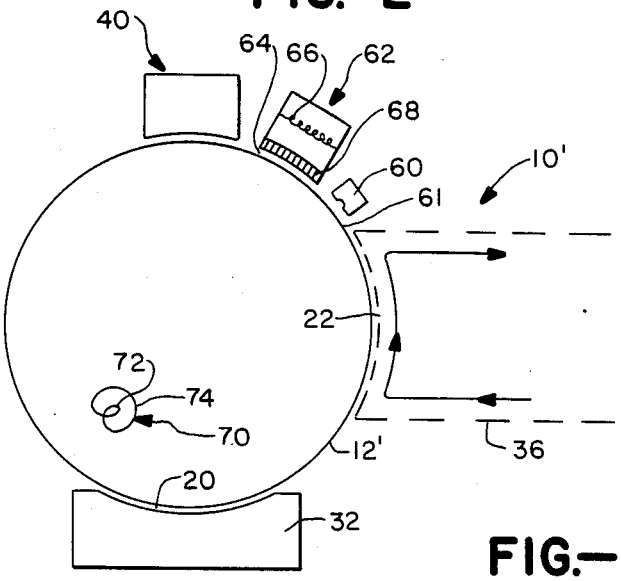
FIG. 3 is a view similar to FIG. 1 of an electrophotographic copying apparatus utilizing a slightly modified photoconductive drum, specifically one which does not include the electrostatic clamp shown in FIG. 2 but rather other means of providing an electrostatic grid for holding residual toner on the drum surface.
Figure 6A:
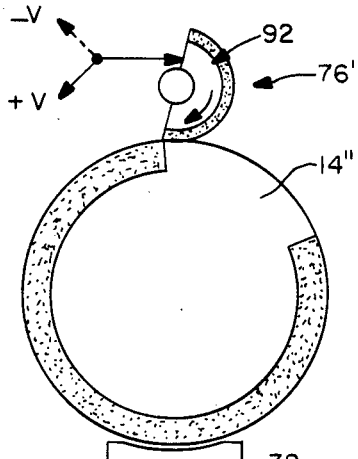
Figure 5A:
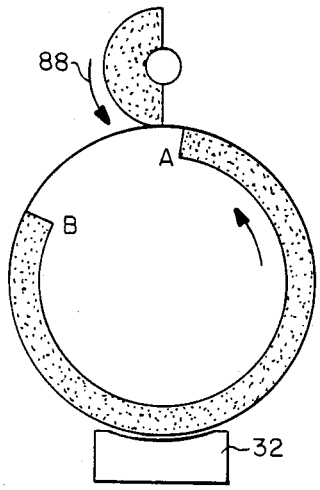
Figure 5B:
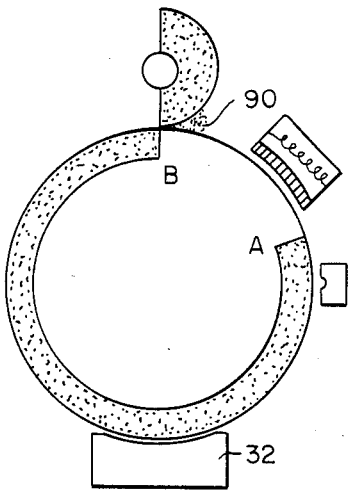
Figure 5C:
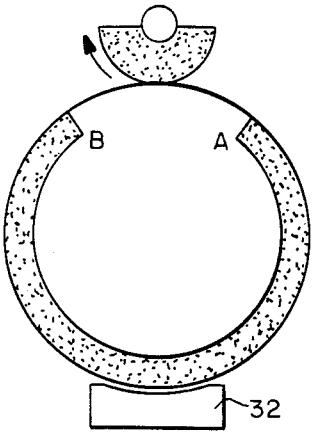
Figure 5D:
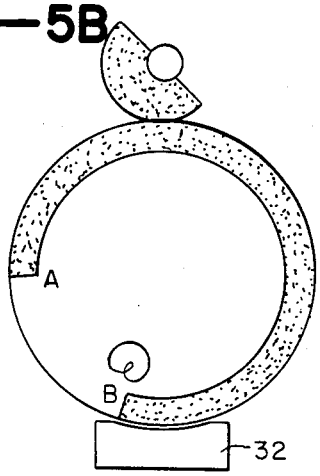
Figure 6:
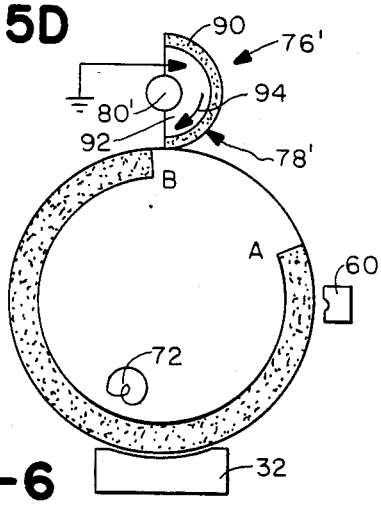

FIGS. 4A–4E diagrammatically illustrate successive steps in the operation of the apparatus shown in FIG. 1 and specifically illustrating how the residual toner is moved from the image bearing segment of the drum surface to its non-image bearing segment and thereafter carried by the drum to a removable point where it can be re-used in the developing process;

FIGS. 5A–5D diagrammatically illustrate successive steps in the operation of the apparatus shown in FIG. 3 and specifically illustrating how residual toner is moved from the image bearing segment of the drum surface to its non-image bearing segment and thereafter carried by the drum to a removal point where it can be re-used in the developing process; and FIGS. 6 and 6A diagrammatically illustrate parts of an electrophotographic copying apparatus designed in accordance with two additional embodiments of the present invention.

Turning now to the drawings, wherein like components are designated by like reference numerals throughout the various figures, attention is first directed to FIG. 1 which, as stated above, illustrates an electrophotographic apparatus designed in accordance with the present invention. This apparatus is generally indicated by the reference numeral 10 and includes a rotatable photoconductive drum 12 having a photosensitive outer circumferential surface 14 and means (not shown) for rotating the drum in a controllable manner so as to cause surface 14 to move along a fixed annular path through a charging station 16, an exposure station 18, a developing station 20, a transfer or copy forming station 22, and finally a drum cleaning station 24. In the embodiment shown, an actual cylindrical drum is shown. However, any suitable photoconductor could be used, such as an endless belt. Nevertheless, for purposes of convenience, the term "photoconductive drum" will be used, it being understood that this term refers to any photoconductor compatible with the present invention.

In actual operation, drum 12 is caused to rotate in the direction of arrow 26 for bringing a first segment 14' of photosensitive surface 14, the segment darkened in FIG. 1, through charging station 16 where means including a suitable charging unit 28 providing a high voltage is used to charge the surface. In this embodiment, most but not all of the circumference of drum surface 14 is charged, thereby leaving an uncharged segment 14'' (the non-darkened segment shown in FIG. 1). The charged circumferential segment 14' of drum surface 14 is moved through exposure station 18 where a like image of an original or master (not shown) is projected onto the moving drum depicted by arrow 30, in order to discharge portions of its discharge surface and thus form an electrostatic latent image conforming to the original. The electrostatic latent image thus formed is then moved through developing station 20 which contains a suitable arrangement generally indicated at 32 including a supply of toner charged to a polarity opposite that of the latent image and means for applying the toner to the drum surface. Thus, as the image bearing drum surface moves through developing station 20, the charged toner is applied thereto causing it to develop the image, that is, form a visible powder image of the original.

Immediately after the latent image on drum surface 14 has been developed, it is moved through transfer station 22 which contains an arrangement 34 including means generally indicated by dotted lines at 36 for carrying a continuous supply of blank paper through a fixed path indicated by arrows 38 for engagement with the drum surface along a segment of this path during which the developing toner is transferred from the drum surface to a section of the blank sheet, thereby forming a copy of the original. While not shown, arrangement 34 also includes means for fusing the toner transferred to its sheet for making the copy permanent and means for cutting the permanent copy to the appropriate size corresponding to the original.

After the developed image has been transferred in station 22 in the manner just described, any applied but untransferred toner (residual toner) is moved through cleaning station 24 and acted upon by means of an arrangement 40 in cooperation with drum 12 in a manner to be described hereinafter for moving any residual toner from image bearing segment 14' to non-imge bearing segment 14''. Except for this latter arrangement 40 and the way it cooperates with drum 12 in order to move residual toner from surface segment 14' to surface segment 14'' and thereafter to a removal point while being held on segment 14'', the various components making up overall apparatus 10, as recited thus far, may be identical to the corresponding components in previously recited patent application Ser. No. 199,096 or they may be otherwise readily provided by those with ordinary skill in the electrophotographic copying art. In addition, these components function to make copies of an original in the manner described in this last-mentioned application or any other known manner. In this regard, like the electrophotographic copying apparatus described in patent application Ser. No. 199,096, apparatus 10 is designed to make more than one copy from a single latent image. Therefore, charging unit 28 remains on only long enough to initially charge the appropriate segment of drum surface 14.

In addition to the various components discussed above, whether illustrated or not, apparatus 10 may include other suitable and readily providable components. One such component which is shown is a discharge lamp generally indicated at 42 positioned in close proximity to drum surface 14 immediately upstream from charging station 16, as illustrated in FIG. 1. This discharge lamp serves to neutralize the drum surface after the last copy is made from a given latent image.

Figure 2:
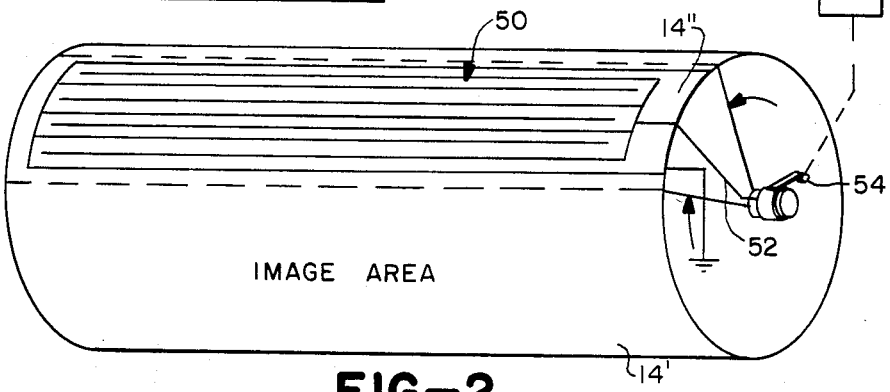
FIG. 2 is a perspective view of the photoconductive drum, specifically illustrating an electrostatic clamp which forms part of the drum's circumferential surface and which serves to electrostatically hold residual toner thereon.

As indicated above, once residual toner is transferred from the image bearing segment 14' of drum surface 14 to non-image bearing segment 14'', the residual toner is moved on the drum to a removal point. The residual toner is moved onto segment 14'' at station 24 which may be referred to as the pick-up point and it is preferably removed at station 32 which may be referred to as its removal point. In accordance with one aspect of the present invention, photoconductive drum 12 is designed to electrostatically hold the residual toner on surface segment 14'' as the latter moves from its pick-up point to its removal point. This is best illustrated in FIG. 2 where surface segment 14'' located within the illustrated dotted lines is shown including an electrostatic clamp 50 in the form of a grid. As seen in FIG. 2, the grid is connected by means of lead line 52 and a suitable commutator 54 or like means to a supply of voltage 56, for example, 1000 volts DC, through a means 58 for controllably connecting and disconnecting the clamp and the voltage supply together for energizing and de-energizing the clamp. Control means 58 which, for example, may be an electronic switch, includes means not shown cooperating with the drum rotating means for sensing the position of the latter in order to energize and de-energize the clamp at the appropriate time in the overall photocopying procedure to be described hereinafter. For the moment, it suffices to say that the energization of clamp 50 results in the production of an electrostatic grid on segment 14'' of the drum surface and that the residual toner on this segment is electrostatically attracted to the grid. In other words, clamp 50 when energized aids in holding residual toner on surface segment 14''.

Clamp 50 is intended to establish closely spaced areas of differing potentials which can be referred to as areas of electrostatic contrast. The potentials of these adjacent areas can be positive versus negative, positive or negative versus ground, both positive but of differing magnitudes or both negative of differing magnitudes. While the specific clamp illustrated shows a simple interlocking grid, the pattern could be of virtually any conceivable geometric pattern so long as the principle of closely spaced areas of electrostatic contrast is adhered to. Additionally, the grid could be vacuum coated on the photoconductive surface or could be manufactured separately and bonded to the photoconductor as a secondary operation. The grid could be merely narrow strips of a conductor bonded to the drum where the spaces between the strips are left at ground potential and the conductive strips are charged to the appropriate potential. To summarize, what is needed is a grid pattern, a means to apply voltage to create the areas of electrostatic contrast, and a means to remove the electrostatic contrast at the proper time so that this transport area can be cleaned. For purposes herein, the terms "clamp" and "grid" refer to these various approaches. Additionally, this grid area could incorporate irregularities in surface topography to mechanically assist in the cleaning of the foam roll.

It is important to note that the use of an electrostatic grid or other means for establishing areas of electrostatic contrast has a number of advantages over merely providing a uniform change over surface segment 14''. For example, the grid results in what is known as "fringe field effect" resulting in a greater toner holding capability. The areas of electrostatic contrast generally establish electrostatic fields immediately over surface segment 14'' which aid in attracting toner particles to the surface segment. These areas of contrast also aid in retaining toner particles of opposite polarities in the event "wrong sign" toner is accidentally provided.

The non-image bearing segment 14'' of drum surface 14 can be provided with an electrostatic grid which functions in the manner just described without utilizing clamp 50. Rather, an electrostatic grid can be deposited on surface segment 14'' by means of a charging arrangement 60 and discharge arrangement 62 forming part of apparatus 10' illustrated in FIG. 3. This apparatus differs from apparatus 10 to the extent that its drum indicated at 12' does not include clamp 50 and components 54, 56 and 58 associated therewith, but does include arrangements 60 and 62. Otherwise, apparatus 10' may be identical to apparatus 10. Arrangement 60 is of any suitable type, for example, one similar to charging unit 28, for charging the entire segment 14'' of drum surface 14 as segment 14'' rotates through a charging station 61 immediately downstream from transfer station 22. Arrangement 62 is located directly downstream from arrangement 60 so as to define a discharge station 64 through which the charged surface segment 14'' passes. Arrangement 62 includes suitable discharge means 66, for example, a discharge lamp, and a light opaque stationary grid 68 corresponding to the grid shape of clamp 50. In operation, after the entire surface of segment 14'' has been charged, it is moved directly under stationary grid 68 and lamp 66 is flashed (the drum may be momentarily stopped) in order to effect an electrostatic grid pattern on segment 14'' corresponding to the pattern made by clamp 50. This deposited electrostatic grid serves the same purpose as clamp 50 when the latter is energized which is to provide the previously discussed electrostatic contrast. Other possible arrangements could be provided to accomplish the same result such as a pulsing corotron, a corotron where current flow to the drum is mechanically interrupted to effect the desired pattern or a uniformly charged area that is selectively discharged with a pulsed light source. A further arrangement 70 is located immediately upstream from developing station 32 and serves to discharge the deposited grid as segment 14'' moves into developing station 20, as will be seen hereinafter. This arrangement includes a discharge lamp 72 and reflector 74 disposed internally of the drum. In this regard, the drum itself is formed of a translucent substrate.

A particular advantage of the grid producing arrangement just described over the previously described clamp is that the clamp, being a physical entity, once positioned on the drum is, practically speaking, not movable. The grid, since it has no physical embodiment can be deposited at any desired position on the periphery of the drum. That is, the hardware used to deposit the electrostatic grid can be software controlled to position the grid selectively as when the machine operator changes the size of the original to be copied.

Referring to FIGS. 4A–4E, attention is now directed to the way in which residual toner is moved from segment 14' of drum surface 14 to segment 14'' and the way in which this toner is ultimately removed therefrom at developing station 20. To this end, arrangement 40 includes a member generally indicated at 76 in FIGS. 4A–4E. In the embodiment illustrated, member 76 includes a compliant, preferably foam rubber, roller segment 78 which is semicylindrical in configuration (e.g., semicircular in cross section) fixedly supported on a rotatable shaft 80. Shaft 80 is located sufficiently close to drum surface 14 at cleaning station 24 so that the semicylindrical surface 82 of roller 78 engages the drum surface, as illustrated in FIGS. 4A–4E. While not shown, arrangement 40 also includes means for rotating shaft 80 and therefore roller segment 78 in a controlled manner to be described below. In this regard, means also not shown are provided for synchronizing the movement of shaft 80 with movement of the drum in order to provide the necessary rotation of roller 78 to be described.

Figure 4A:
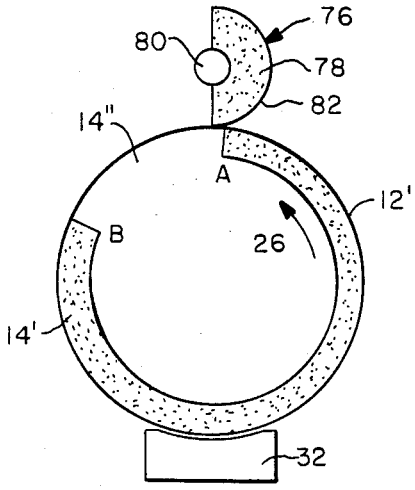
Figure 4B:
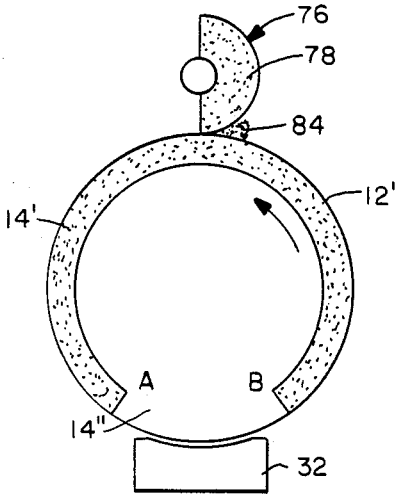
Figure 4C:
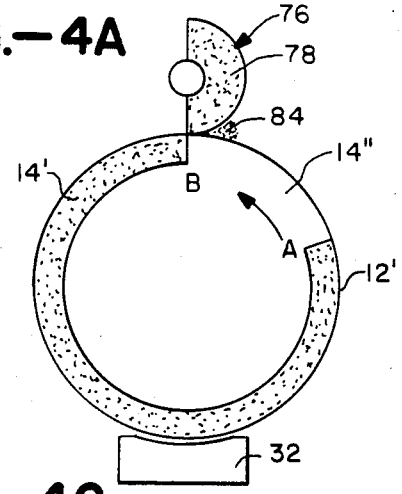

Referring specifically to FIG. 4A, drum 12 is shown in its operating cycle where the forwardmost end A of image bearing segment 14' is just entering cleaning station 24 downstream of transfer station 22. At this point in the cycle, semicylindrical roller 78 is fixedly maintained in the position illustrated such that a lowermost longitudinal edge of cylindrical surface 82 engages the drum surface. As the drum rotates in the direction of arrow 26, segment 14' continues to move under and against the roller (see FIG. 4B) until the rearwardmost end B of segment 14' reaches station 24, as depicted by FIG. 4C. During this process, residual toner accumulates in front of roller 78 as best illustrated at 84 in FIG. 4B. Because the roller is constructed of foam rubber or similar porous material, some of the toner particles find their way into the roller's pores.

Figure 4D:
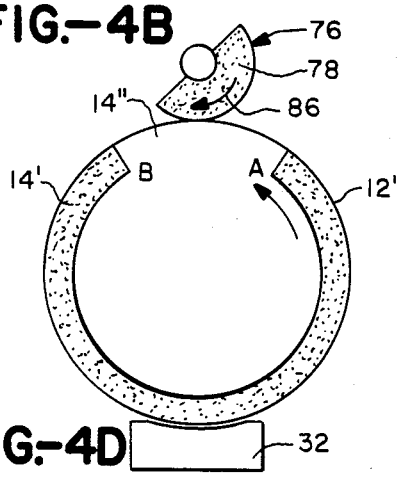
Figure 4E:
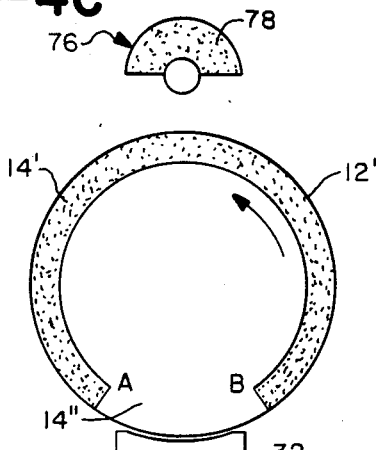

It is necessary that the electrostatic clamp 50 be maintained in an energized state during the toner pick-up phase at the position shown in FIG. 4C and in a de-energized state during the toner removal phase at the position shown in FIG. 4E. It may be desirable to maintain the clamp in an energized state at all times except at the toner removal point (FIG. 4E). In this case the clamp would act as a trap for free floating toner in its vicinity and thus perform an additional function of reducing the level of contamination in the machine cavity. When drum 12 reaches the point illustrated in FIG. 4C, the clamp is energized in order to assure that the accumulated toner 84 remains thereon as segment 14'' moves around to developing station 20. As segment 14'' moves under the roller 76, the latter is rotated about the axis of shaft 80 in the direction of arrow 86 at the same rate of speed as drum 12, as best seen in FIG. 4D. This causes surface 82 of member 78 to progressively engage surface segment 14''. In this regard, the diameter of semicylindrical member 78 is selected so that a circumferential length of surface 82 is equal to or less than the circumferential length of surface 14''. In this way, the entire surface 82 engages surface segment 14'' which in turn allows the electrostatic grid formed by energized clamp 50 to attract and thereby draw out much of the toner within the pores of roller 78. In other words, the electrostatic grid not only aids in maintaining the toner particle on surface segment 14'', but also cleans the roller of toner particles. As soon as roller 78 rotates 180° and off of surface segment 14'', it continues another 90° to the position illustrated in FIG. 4E and thereafter waits to repeat the cycle by moving back to its FIG. 4A position. In the meantime, drum 12 continues to rotate in the direction of arrow 26 until surface segment 14'' reaches developing station 20 (see FIG. 4E). At that time, clamp 50 is de-energized, and the residual toner 84 is freed of any electrostatic attraction. At the same time, means not shown forming part of arrangement 32 may be utilized to brush the accumulated toner off of the drum surface. In this regard, the electrical bias on the development electrode or electrodes within the development station (but not shown) should be adjusted in such a manner to produce the most favorable conditions for removing the toner from surface segment 14'' as the latter passes through the developing station.

While overall member 76 has been illustrated in the form of a semicylindrical roller mounted to a rotatably driven shaft 80, it is to be understood that other brushing type of members could be utilized. Moreover, in the case of roller 76, the shaft 80 could be coupled to the drum rotating means by suitable gears including a clutch which is controllably engaged and disengaged at the appropriate times to provide the procedure described above.

Referring to FIGS. 5A–5D, the same member 76 is illustrated in combination with drum 12'. In FIG. 5A, the drum and member 76 are shown in positions corresponding to FIG. 4A such that image bearing surface segment 14' is just entering cleaning station 24. However, the roller 78 is positioned 180° out of phase with its FIG. 4A position. This places surface 82 in a rearwardly facing direction with its lowermost end engaging the drum surface. Thereafter, drum 12' rotates in the direction of arrow 26 until the trailing edge B of segment 14' passes through cleaning station 24, as depicted in FIG. 5B. During this rotation of drum 12', roller 78 rotates 180° in the direction of arrow 88. This causes toner to accumulate in front of the roller, as indicated at 90 in FIG. 5B, and also within the roller, as described above.

Figure 5E:
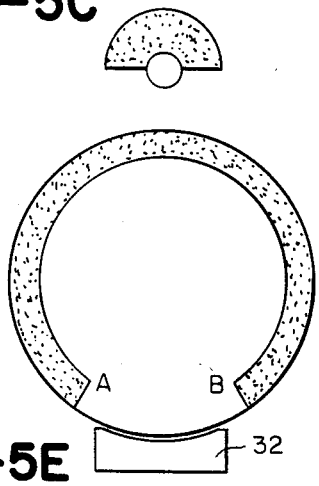

After roller 78 has moved toner 90 onto surface segment 14'' as illustrated in FIG. 5B, the drum continues to rotate in the direction of arrow 26 while charging arrangement 60 and lamp 66 are energized, thereby depositing an electrostatic grid on surface 14'' similar to the electrostatic grid produced by grid 50. At the same time, roller 78 is allowed to rotate freely in the direction of arrow 86 (see FIG. 5C) as a result of its engagement with the drum surface (or as otherwise rotated in that direction) in order to allow the deposited electrostatic grid to clean the roller while at the same time maintaining the accumulated toner on surface 14''. The drum continues to rotate through its FIG. 5C position to its FIG. 5D position, at which time, the discharge lamp 72 is energized for removing the electrostatic grid previously deposited on surface segment 14''. The drum continues to rotate moving this latter segment through the developing station and causing the accumulated toner to be removed therefrom as described above. At the same time, the roller 78 moves to its FIG. 5E position where it awaits the start of a new cycle.

Referring to FIG. 6, attention is directed to a modified member 76' cooperating with drum 12'. In this particular embodiment, a charging arrangement 60 is utilized but discharge arrangement 62 has been omitted. Member 76' is similar to previously described member 76 to the extent that it includes a semicylindrical roller 78' mounted to a rotating shaft 80'. However, roller 78' includes an outer foam layer 90 mounted over a grounded electrode 92. There is no electrostatic grid formed on surface 14'' as the latter moves through cleaning station 24. Rather, arrangement 60 charges the entire surface. This charged surface cooperates with electrode 92 as surface segment 14'' passes under the latter for producing an electrostatic field therebetween. This field serves to cause particles on and in the roller to be attracted to surface segment 14''. In other words, this electrostatic field serves to clean the roller of toner particles accumulated thereon. In this regard, as surface segment 14'' moves through the cleaning station, roller 78' is rotated 180° in the direction of arrow 94.

A further variation as demonstrated in FIG. 6A envisions an electroded foam roll that is electrostatically active in the pickup phase. Electrode 92 could be positively (for negative toner) biased during the pickup cycle than biased strongly negative for the deposition cycle. In this case, the pickup/transport zone 14'' would be at zero potential, thus eliminating the need for charging station 60 and discharge station 70. The negative toner would gravitate to the most positive surface, in this case, the surface designated 14'', and thence be transported as described above. Since area 14'' is never charged and does not require backlighting at discharge station 70, this system is not restricted to machines with translucent drums. Moreover, since this system has, comparatively, exceedingly few parts, it is very simple and inexpensive.

What is claimed:

1. An apparatus for electrophotographically copying information from a given master, comprising (a) means including a rotatable drum having a photosensitive coating on its entire outer circumferential surface;

(b) means for rotating said drum about its longitudinal axis in a controlled fashion such that said photosensitive outer circumferential surface moves along a fixed annular path;

(c) means for forming a given electrostatic image corresponding to said information on a first circumferential segment of said drum surface;

(d) means for applying toner from a given toner storage area onto the image bearing first segment of said drum surface in a way which develops said image;

(e) means for transferring applied toner from said first segment of said drum to a support surface to form a copy of said image;

(f) toner moving means for causing any applied but untransferred toner on the first segment of said drum surface to be moved onto a second circumferential segment of said drum at a first point on said annular path;

(g) means for rotating said drum in a way which moves said second segment from said first point to a second point on said annular path; and (h) means located on said second segment for electrostatically holding said moved toner on said second surface segment while said second segment moves from said first point to said second point and for removing the toner on said second segment from the latter when the second segment reaches said second point, said holding and removing means being configured to establish an area of electrostatic contrast on said second surface segment for enhancing the toner holding capabilities of said holding means for aiding in attracting toner particles to said second surface segment by means of a resultant electrostatic field or fields, said electrostatic holding and toner removing means includes means for energizing an electrostatic clamp in the shape of a grid on said second segment of said drum surface during the period of time that said second segment moves from said first point to said second point whereby to establish said areas of electrostatic contrast and resultant fields for holding said toner on said second segment and means for later de-energizing said clamp for eliminating said electrostatic grid when said second segment reaches said second point whereby to allow the toner on said second segment to be removed therefrom.

2. An apparatus for electrophotographically copying information from a given master, comprising (a) means including a rotatable drum having a photosensitve coating on its entire outer circumferential surface;

(b) means for rotating said drum about its longitudinal axis in a controlled fashion such that said photosensitive outer circumferential surface moves along a fixed annular path;

(c) means for forming a given electrostatic image corresponding to said information on a first circumferential segment of said drum surface;

(d) means for applying toner from a given toner storage area onto the image bearing first segment of said drum surface in a way which develops said image;

(e) means for transferring applied toner from said first segment of said drum to a support surface to form a copy of said image;

(f) toner moving means for causing any applied but untransferred toner on the first segment of said drum surface to be moved onto a second circumferential segment of said drum at a first point on said annular path;

(g) means for rotating said drum in a way which moves said second segment from said first point to a second point on said annular path; and (h) means located on said second segment for electrostatically holding said moved toner on said second surface segment while said second segment moves from said first point to said second point and for removing the toner or said second segment from the latter when the second segment reaches said second point, said holding and removing means being configured to establish an area of electrostatic contrast on said second surface segment for enhancing the toner holding capabilities of said holding means for aiding in attracting toner particles to said second surface segment by means of a resultant electrostatic field or fields, said electrostatic holding and toner removing means includes means for providing said electrostatic grid as electrostatic charges on said second drum surface segment during the period of time that said second segment moves from said first point to said second point whereby to establish said area of electrostatic contrast and resultant fields for holding said toner on said second segment and means for eliminating said charges when said second segment reaches said second point to allow the toner on said second segment to be removed therefrom, whereby said first and second drum surface segments can vary on the overall drum surface.

3. An apparatus according to claim 2 wherein said means for providing said grid as electrostatic charges includes means for depositing electrostatic charges uniformly on said second surface segment and means for selectively discharging said second surface segment so as to form said grid.

4. An apparatus according to claim 1 wherein said toner moving means includes a roller segment of compliant material and means for first placing said roller segment into engagement with said first segment of said drum surface as the drum is rotated and after said applied toner is transferred from said first segment to form said copy in order to cause any applied but untransferred toner to accumulate on said second segment of said drum surface and/or on the roller segment itself, and for thereafter placing said roller segment in engagement with said second surface segment as the drum is rotated and after said electrostatic grid has been provided on said second surface segment whereby to transfer any of said toner accumulated on said roller segment to said second surface segment.

5. An apparatus according to claim 4 wherein said roller segment is semicircular in cross section and wherein said means for placing said roller segment in engagement with said drum surface includes means for rotating said roller segment in a controlled manner.

6. An apparatus according to claim 5 wherein said roller segment is made of porous foam rubber.

7. An apparatus for electrophotographically copying information from a given master, comprising (a) means including a rotatable drum having a photosensitive coating on its complete outer circumferential surface;

(b) means for rotating said drum about its longitudinal axis in a controlled fashion such that said photosensitive outer circumferential surface moves along a fixed annular path;

(c) means for forming a given electrostatic image corresponding to said information on a first circumferential segment of said drum surface;

(d) means for applying toner from a given toner storage area onto the image bearing first segment of said drum surface in a way which develops said image;

(e) means for transferring applied toner from said segment of said drum to a support surface to form a copy of said image;

(f) means for causing any applied but untransferred toner on the first segment of said drum surface to be moved onto a second circumferential segment of said surface;

(g) means forming part of said last-mentioned toner moving means and part of said second surface segment for establishing an electrostatic field therebetween in order to electrostatically aid said moving means in moving the applied but untransferred toner onto said second surface segment;

(h) means for rotating said drum in a way which moves said second drum segment to a different location on said annular path with said applied but untransferred toner thereon; and (i) means for removing said applied but untransferred toner from said second segment of said drum surface when said second segment reaches said different location, said toner moving means includes a roller segment of compliant material, and means for first placing said roller segment into engagement with said first segment of said drum surface as the drum is rotated and after said applied toner is transferred from said first segment to form said copy in order to cause any applied but untransferred toner to accumulate on said second segment of said drum surface and/or on the roller segment itself and for placing said roller segment in engagement with said second surface segment as the drum is rotated whereby to further aid in transferring any of said toner accumulated on said roller segment to said second surface segment.

8. An apparatus according to claim 7 wherein said electrostatic field establishing means includes means for depositing a charge on said second surface segment and means forming part of said toner moving means and serving as an electrode biased with voltage relative to said charge for establishing said electrostatic field between said electrode and charged surface.

9. An apparatus according to claim 7 wherein said roller segment is semicircular in cross section and wherein said means for placing said roller segment in engagement with said drum surface includes means for rotating said roller segment in a controlled manner.

10. An apparatus according to claim 9 wherein said roller segment is made of porous foam rubber.

11. An apparatus for electrophotographically copying information from a given master, comprising (a) means including a rotatable drum having a photosensitive coating on its complete outer circumferential surface;

(b) means for rotating said drum about its longitudinal axis in a controlled fashion such that said photosensitive outer circumferential surface moves along a fixed annular path;

(c) means for forming a given electrostatic image corresponding to said information on a first circumferential segment of said drum surface;

(d) means for applying toner from a given toner storage area onto the image bearing first circumferential segment of said drum surface in a way which develops said image;

(e) means for transferring applied toner from said segment of said drum to a support surface to form a copy of said image;

(f) toner moving means for causing any applied but untransferred toner on the first segment of said drum surface to be moved into a second circumferential segment of said drum surface at a first point on said annular path, said toner moving means including a roller engaging member of compliant material, means for first placing said member into engagement with said first segment of said drum surface as the drum is rotated and after said applied toner is transferred from said first surface segment to form said copy in order to cause any applied but untransferred toner to accumulate on said second segment of said drum surface and/or on the member itself and for thereafter placing said member in engagement with said second surface segment as the drum is rotated, and means for at least aiding in transferring any toner accumulated on said member to said second surface segment as the two engage one another;

(g) means for rotating said drum in a way which moves said second surface segment from said first point to a second point on said annular path; and (h) means for removing said accumulated toner from said drum surface when the accumulated toner reaches said different location, said means for aiding in the transfer of toner from said compliant member to said second surface segment includes means for establishing an electrostatic field over said second surface segment.

12. An apparatus according to claim 11 wherein said means for aiding in the transfer of toner from said compliant member to said second surface segment includes means for establishing an electrostatic field over said second surface segment.

13. An apparatus according to claim 12 wherein said compliant member is configured as a semi-cylinder and wherein said means for placing said member in engagement with said first and second segments of said drum surface includes means for rotating it about its cylindrical axis in a controlled manner.

14. An apparatus according to claim 13 wherein said member is made of porous foam rubber.

15. A method of electrophotographically copying information from a given master, comprising the steps of (a) providing a rotatable drum having a photosensitive outer circumferential surface and means for rotating the drum about its longitudinal axis and along a fixed annular path in a controlled fashion;

(b) forming a given electrostatic latent image corresponding to said information on a first circumferential segment of said drum surface;

(c) applying toner from a given toner storage area onto the image bearing first segment of said drum surface in a way which develops said image;

(d) transferring applied toner from said segment of said drum to a support surface to form a copy of said image;

(e) establishing an area of electrostatic contrast on said second surface segment for electrostatically holding said moved toner on said second surface segment while said second segment moves from said first point to said second point on said annular path;

(f) after the application of toner onto said first segment of said drum surface bearing said given image and the subsequent transfer of said applied toner onto an associated support surface at least once in order to produce at least one copy and after establishing said electrostatic contrast area, causing any applied but untransferred toner on said first segment to be moved onto a second circumferential segment of said surface at a first point on said annular path;

(g) rotating said drum in a way which moves said second segment from said first point to a second point on said annular path; and (h) eliminating said areas of electrostatic contrast for removing said toner on said second segment from the latter when the second segment reaches said second point, said steps of establishing and eliminating said areas of electrostatic contrast including the steps of providing an electrostatic grid on said second segment during the period of time that said second segment moves from said first point to said second point whereby to hold said toner on said segment and thereafter eliminating said electrostatic grid when said second segment reaches said second point whereby to allow the toner on said second segment to be removed therefrom, said step of causing said applied but untransferred toner on said first surface segment to be moved onto said second segment including the steps of providing a roller segment of compliant material, placing said roller segment into engagement with said first segment of said drum surface while rotating the latter after said applied toner is transferred from said first segment to form said copy in order to cause the applied but untransferred toner to accumulate on said second segment of said drum surface and/or the roller segment itself, and thereafter placing said roller segment in engagement with said second surface segment while rotating the drum and after said electrostatic grid has been provided on said second segment whereby to transfer any of said toner accumulated on said roller segment to said second surface segment.

16. A method according to claim 15 wherein said roller segment is semi-circular in cross section, wherein said step of placing said roller segment in engagement with said first drum surface segment includes the step of maintaining said roller segment in a stationary position as said drum is rotated, and wherein said step of placing said roller segment in engagement with said second drum surface segment includes rotating the drum segment about an axis parallel to the axis of said drum at the same rate of rotation as that of the drum but in the opposite direction.

* * * * *

UNITED STATES PATENT AND TRADEMARK OFFICE

CERTIFICATE OF CORRECTION

PATENT NO. : 4,572,655

DATED : February 25, 1986

INVENTOR(S) : Elden R. Morrison, Edward F. Mayer, Donald F. Pfeuffer and Victor B. Van Blerk It is certified that error appears in the above—identified patent and that said Letters Patent is hereby corrected as shown below:

On the title page Assignee should read:

[73] Assignee: Ricoh Company, Ltd., Tokyo, Japan

Signed and Sealed this

*First* Day of *July 1986*

[SEAL]

*Attest:*

DONALD J. QUIGG

*Attesting Officer*

*Commissioner of Patents and Trademarks*